United States Patent [19]

Hamsher, Jr. et al.

[11] 4,428,635

[45] Jan. 31, 1984

[54] ONE PIECE ZIF CONNECTOR

[75] Inventors: Wilbur A. Hamsher, Jr., Carlisle; Robert N. Weber, Hummelstown, both of Pa.

[73] Assignee: AMP Incorporated, Harrisburg, Pa.

[21] Appl. No.: 351,713

[22] Filed: Feb. 24, 1982

[51] Int. Cl.[3] ..... H01R 13/62

[52] U.S. Cl. ..... 339/74 R; 29/832; 339/75 MP; 339/176 MP

[58] Field of Search ..... 339/74 R, 75 M, 75 MP, 339/176 MP; 29/832, 834, 842

[56] References Cited

U.S. PATENT DOCUMENTS

| | | | |
|---|---|---|---|
| 3,345,604 | 10/1967 | Henschen et al. | 339/75 M |
| 3,899,234 | 8/1975 | Yeager et al. | 339/74 R |
| 3,920,302 | 11/1975 | Cutchaw | 339/176 MP |
| 4,047,782 | 9/1977 | Yeager | 339/75 MP |
| 4,094,570 | 6/1978 | de Barros | 339/75 M |
| 4,165,909 | 8/1979 | Yeager et al. | 339/75 MP |
| 4,189,200 | 2/1980 | Yeager et al. | 339/75 MP |
| 4,303,294 | 12/1981 | Hamsher, Jr. et al. | 339/74 R |

FOREIGN PATENT DOCUMENTS

| | | | |
|---|---|---|---|
| 2643150 | 3/1978 | Fed. Rep. of Germany | 339/74 R |

*Primary Examiner*—John McQuade
*Assistant Examiner*—Gary F. Paumen
*Attorney, Agent, or Firm*—Russell J. Egan

[57] ABSTRACT

A method and connector are disclosed for making a zero insertion force connection between mating members while providing a contact wiping action. The connector has a housing, a plurality of terminals mounted in the housing, a cam mounted for longitudinal movement in the housing and a cam follower mounted between the cam and each row of terminals. Movement of the cam from a first to a second position causes the terminals to open to receive the mating member, return movement to the first position allows the terminals to engage the mating member, movement to a third position causes a first wiping action by the terminals and return to the first position causes a reverse wiping action.

10 Claims, 5 Drawing Figures

ONE PIECE ZIF CONNECTOR

The present invention relates to a zero insertion force electrical connector for making connection between a mother and daughter circuit boards, and in particular, to a connector providing high density interconnection.

There are many well known low or zero insertion force electrical connectors designed to receive edge portions of circuit boards in such fashion as to cause low wear of the circuit pads. A well known example of such a connector can be found in U.S. Pat. No. 3,899,234, the disclosure of which is incorporated herein by reference. The rotary cam actuated low insertion force edge board connector disclosed therein has a housing with an elongated circuit board receiving aperture, a rotary cam extending longitudinally in the base of the aperture, cam follower-contact driving means mounted in the aperture to be driven by the rotary cam, and a plurality of contacts mounted on opposite sides of the aperture engageable with the cam follower to be driven between positions engaging and disengaging a circuit board received in the connector. There have been a number of improvements to this basic connector such as the remote cam actuation means shown in U.S. Pat. No. 4,047,782, the cam follower of U.S. Pat. No. 4,189,200 which produces a sequential action of the contacts, and the edge board lock of U.S. Pat. No. 4,165,909. None of these patents, however, solves the problem of how to achieve a wiping action of the contacts on the pads of the daughter circuit board. Such an action is important to assure proper electrical contact as it is not unusual for the surfaces of the daughter circuit board to become corroded or otherwise coated so as to prevent a good interconnection from being formed.

A specialized terminal configuration has been disclosed in my U.S. Pat. No. 4,303,294 which can be used with any of the above mentioned connectors with the terminal itself providing a wiping action.

According to the present invention, the electrical connector is used for establishing electrical connections between conductors on a mother board and a like plurality of pads on a daughter board with the connector comprising an elongated housing of electrically insulating material defining a slot for receiving an edge portion of the daughter board, a plurality of terminals fixed in the housing to make contact with pads on the daughter board, and an operating member mounted in the housing for movement relative thereto with such movement of the operating member serving to move the terminals with respect to the path of the daughter board being inserted into the slot in the housing and to allow the terminals to engage the daughter board pads with a wiping action. The operating member is movable between three positions relative to the housing, with movement from a first position to a second position serving to move the terminals out of the path of the daughter board being inserted into the slot; movement from the second to the first position allowing the terminals to engage pads of the inserted daughter board; and movement from the third to the first position causing the terminals to wipe over the pads in one directon; and movement from the third to the first position causing the terminals to wipe over the pads in the opposite direction.

Preferably, the movement of the operating member from the first to second positions and from the first to third positions is against a bias force applied by the terminals, which bias force serves to move the operating member from the second to the first and from the third to the first positions.

A zero insertion force edge board connector according to the present invention will now be described by way of example with reference to the drawings in which.

Figure 1:
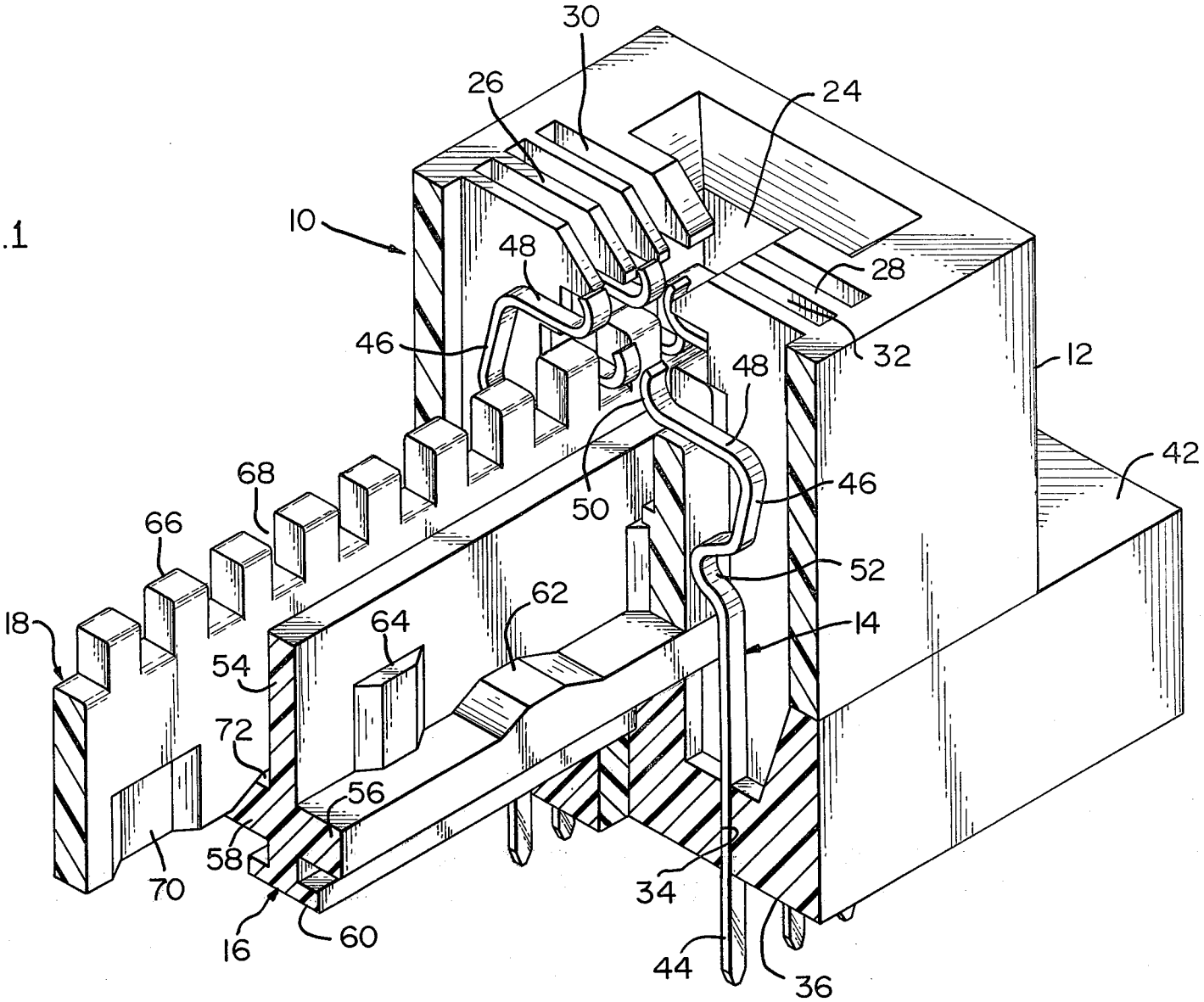
FIG. 1 is a perspective view of the subject invention with parts broken away.

The subject connector 10 is formed with an elongated housing 12 of insulative material having a plurality of terminals 14 mounted therein to be driven by a cam 16 through cam followers 18 so that the connector 10 can be utilized to make an electrical interconnection between a mother board 20 and a daughter board 22.

The connector housing 12 is formed of rigid insulative material which defines an elongated longitudinally extending central aperture 24 which receives the daughter board 22. On both sides of the aperture there are a plurality of parallel spaced apart spacer flanges 26, 28 forming an inwardly directed comb-like profile and defining terminal recesses 30, 32 between adjacent pairs of flanges. A passage 34 extends from the end of each recess 30, 32 through the base 36 of the housing 12. An integral, longitudinally extending cam supporting rail 38 is formed centrally in the base of the aperture 24. The rail 38 is formed with a mating profile 40. The housing 12 also includes mounting flanges 42 at the opposite ends thereof which would be utilized for mounting the connector 10 on the mother board 20 by conventional mounting means.

Each terminal 14 has a mounting tail 44 extending through the passage 34 and depending from the base 36 of the housing 12 for attachment to the mother board 20 in known fashion, as shown in FIGS. 2 to 5. The opposite end of the terminal is formed as a cantilever arm 46 having an inwardly directed free end 48 with a profiled contact portion 50 and a cam engaging profile 52 intermediate the ends thereof.

The cam 16 is an elongated integral member having an inverted T-shaped transverse section including a vertical leg 54 and a pair of transverse arms 56, 58. Centrally of the cam arms 56, 58 and opposite of the leb 54, the cam 16 is further provided with a profile extension 60 which engages in the profile 40 of the rail 38 in housing 12. The cam 16 also includes a plurality of regular trapezoidal shaped cam ramps 62 on the arms 56, 58 directed upwardly along the leg 54 with similarly shaped cam ramps 64 being formed on the leg 54 directed outwardly in association with each respective cam ramp 62.

The cam followers 18 are identical and each is an elongated rigid member of insulative material having one edge with a plurality of spaced projections 66 defining a plurality of recesses 68 therebetween forming a comb-like profile. Each cam follower 18 also includes a plurality of trapezoidal shaped inwardly directed recesses 70 in one side surface thereof and upwardly directed recesses 72 in the bottom edge thereof with the recesses spaced to receive a respective cam ramp 64 and 62 therein when the connector is in a first position. The recesses are so dimensioned that movement of the cam 16 in a first direction from an initial position will bring ramps 64 into engagement with ramps of recesses 70 without ramps 62 engaging recesses 72 while movement in the opposite direction from the initial position causes ramps 62 and recesses 72 to engage while ramps 64 move freely within recesses 70.

Figure 3:
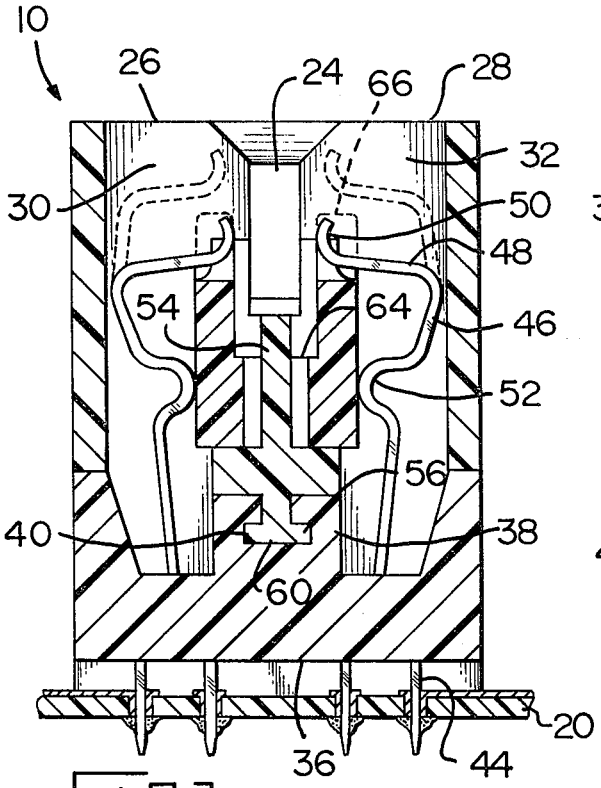
FIG. 3 is a view similar to FIG. 2 showing the connector in the second position with the terminals opened ready to receive the daughter board therein.
Figure 2:
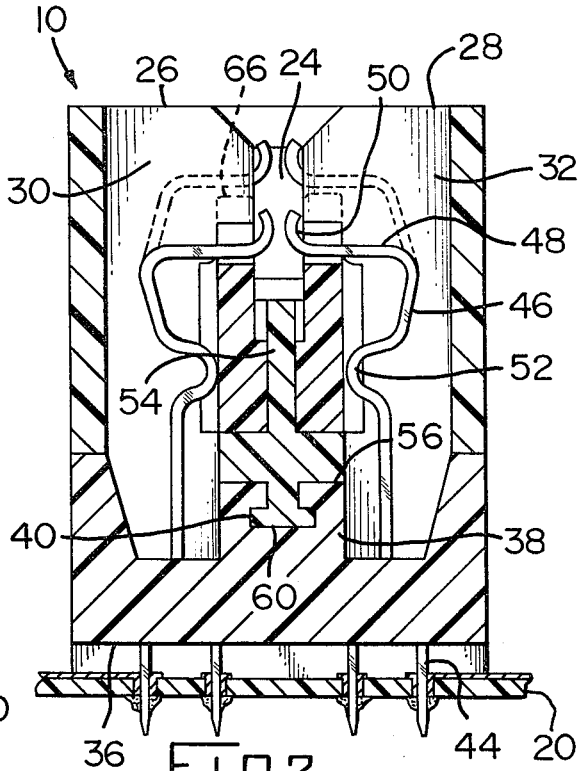
FIG. 2 is a transverse vertical section showing the subject connector in the first position with the terminals relaxed and no daughter board inserted into the connector.
Figure 4:
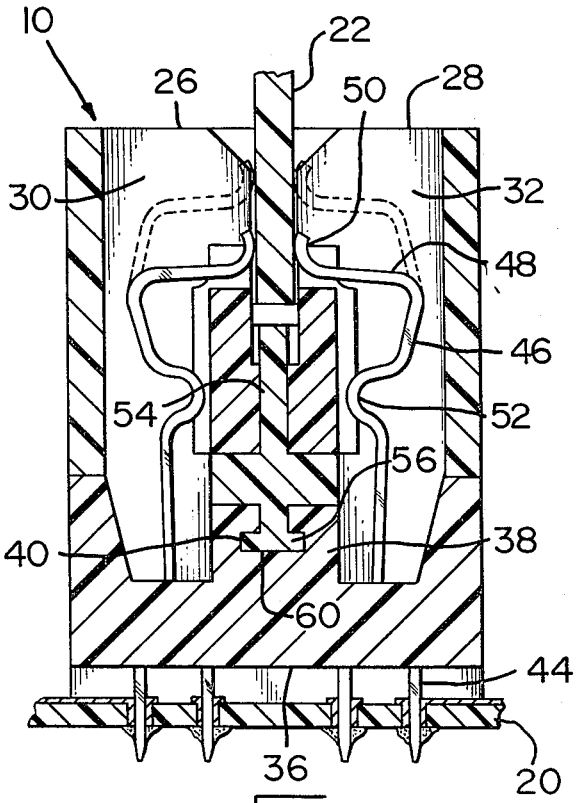
FIG. 4 is a view similar to FIGS. 2 and 3 showing the connector with a daughter board received therein and the terminals toward the third position.
Figure 5:
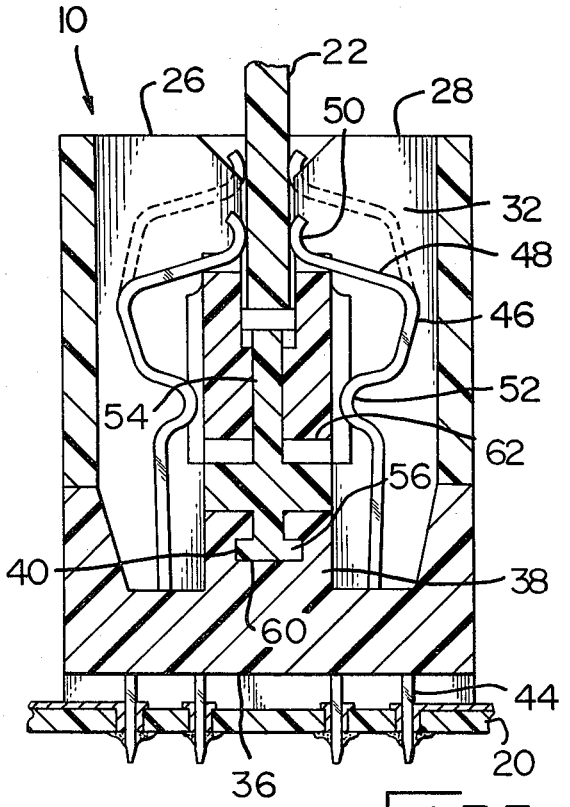
FIG. 5 is a view similar to FIGS. 2 to 4 showing the daughter board fully received in the connector and the terminals returned toward the first condition.

The operation of the present invention will now be described primarily with reference to FIGS. 2 through 4. It will be noted in these sectional views that the cam 16 is constrained for longitudinal movement only within the connector housing 12 by the interengagement of the mating profile 40 of the housing rail 38 with the profiled cam extension 60. The connector is shown in FIG. 2 in the rest or first position with no daughter board inserted into the aperture 24. In this condition the terminals 14 are in their rest condition with their contact portions 50 extending into the aperture 24.

In order to prepare the subject connector 10 to receive a daughter circuit board therein, the cam 16 is actuated in a first direction longitudinally of the housing 12 by known means (not shown). This causes the cam ramps 64 to engage the sides of the recesses 70 and drive the cam followers 18 outwardly or transversely of the aperture 24. The cam engaging profiles 52 of the terminals will cause the terminals 14 to follow the movement of the cam followers 18 so that they will be driven to the second or open condition of the subject invention shown in FIG. 3.

A daughter circuit board 22 is introduced into the connector 10 in the open condition. Return movement of the cam 16 in a second direction again brings the cam ramps 54 into alignment with the recesses 70 allowing the cam followers 18 to be driven transversely back against the cam 16 by the spring action of the terminals 14. This condition, FIG. 4, is similar of that of FIG. 2 except that the daughter board 22 is in place in the connector 10.

Further movement of the cam 16 in the second direction brings the ramps 62 into engagement jwith the recesses 72 driving the cam followers 18 vertically so that the projections 66 and recesses 68 engage the free ends of the terminals 14 and cause them to wipe over the surface of the daughter board 22. When the cam 16 is returned to the starting position the cam followers 18 are returned to their positions as shown in FIG. 4 by the spring action of the terminals 14. As the terminals 14 return to the position shown in FIG. 4, they will effect a reverse wiping action on the daughter board thereby assuring a good electrical contact between the terminals 14 and the pads of the daughter board 22.

We claim:

1. A method for providing zero insertion force between mating connector members while assuring adequate contact wiping action, one said connector member having an elongated housing defining an elongated connector receiving cavity with a plurality of parallel spaced terminals along at least one side of said cavity, a cam extending longitudinally along the base of said cavity and at least one cam follower responsive to said cam to drive said terminals, comprising the steps of:

actuating said cam with a first movement from an initial position to a second position to drive said at least one cam follower apart causing said terminals to be driven transversely of said cavity freeing it for receipt of the mating connector member;

actuating said cam from said second position to allow retraction of said at least one cam follower by the inherent spring action of said terminals bringing the terminals into first engagement with said mating connector member;

further actuating said cam to a third position to drive said at least one cam follower parallel to the mating surfaces of said mating connector member so that said terminals are moved across the surface thereof with a first wiping action; and returning said cam to said initial position allowing said at least one cam follower to return toward the original position under the spring action of said terminals, which return causes a reverse second wiping action on said mating connector member.

2. A method for providing zero insertion force mating between mother and daughter circuit boards wherein said mother circuit board has mounted thereon a elongated connector member having housing defining an elongated daughter circuit board receiving slot with a plurality of parallel spaced terminals fixed along at least one side thereof, a cam extending along a base of said slot and at least one cam follower responsive to said cam to drive said terminals, comprising the steps of:

actuating said cam in a first direction from an initial position to drive at least one cam follower apart transversely of said slot causing said terminals to be driven to a position freeing said slot for receipt of the daughter circuit board therein;

actuating said cam in a second reverse direction to allow retraction of said at least one cam follower apart transversely of said slot causing said terminals to be driven to a position freeing said slot for receipt of the daughter circuit board therein;

continuing actuation of said cam in said second reverse direction to drive said at least one cam follower parallel to the mating surfaces of said daughter circuit board so that said terminals are moved across the surface thereof in a first wiping action; and returning said cam to the initial position allowing said at least one cam follower to return to the original position under the spring action of said terminals, which return movement causes a reverse wiping action on said daughter circuit board.

3. A zero insertion force electrical connector having contact wiping action, said connector comprisng:

an elongated housing of rigid insulative material defining an elongated cavity for receiving a mating connector therein;

a plurality of resilient electrical terminals mounted in said housing in parallel spaced relationship in at least one row along at least one side of said cavity;

an elongated cam mounted in the base of said cavity for longitudinal movement therealong; and at least one cam follower mounted in said cavity between said cam and a respective row of terminals, whereby upon actuation of said cam, said at least one cam follower is first driven outwardly to spread said terminals to receive the mating connector, is returned inwardly allowing the terminals to come into a position engaging the mated connector and then driven upward normal to the first movement to provide a wiping action of the contacts on the surface of said mated connector.

4. A connector according to claim 3 further comprising:

means to contain said cam in said cavity for longitudinal movement only.

5. A connector according to claim 3 further comprising:

first and second sets of cam lobes on said cam extending normal to each other for effecting said outward, inward, and said upward movements of said cam follower respectively.

6. A connector according to claim 5 wherein said cam follower has first and second recesses receiving said first and second cam lobes in prior to actuation of said cam.

7. A zero insertion force electrical connector for connecting a daughter circuit board to a mother circuit board while providing low mating force with contact wiping action, said connector comprising:

an elongated housing of rigid insulative material defining an elongated daughter board receiving cavity therein;

a plurality of resilient electrical terminals mounted in said housing in parallel spaced relationship in at least one row along at least one side of said cavity;

an elongated cam mounted in the base of said cavity for longitudinal movement therealong; and at least one cam follower mounted in said cavity lying between said cam and a respective row of terminals, whereby upon first actuation of said cam from an initial position drives said cam follower outwardly to spread said terminals to receive said daughter circuit board therebetween, return of said cam to said initial position returns the termnals under their own spring action to come into an engaged position with said daughter circuit board, and second actuation of said cam from said initial position drives said cam follower upward parallel to the surfaces of said daughter board to provide a wiping action of said terminals across the surface of said daughter board.

8. A connector according to claim 7 wherein said cam further comprises:

first and second sets of cam lobes extending normal to each other to effect said outward and upward movements, respectively, of said cam follower.

9. A connector according to claim 8 wherein said cam follower further comprises:

first and second series of recesses each receiving therein a respective first and second cam lobe in the initial condition.

10. A connector according to claim 7 further comprising:

means on said housing and mating means on said cam holding the latter for longitudinal movement only of the former.

* * * * *